US009222376B2

(12) United States Patent
Massing et al.

(10) Patent No.: US 9,222,376 B2
(45) Date of Patent: Dec. 29, 2015

(54) CAM FOLLOWER SYSTEM FOR ENGINE

(71) Applicant: General Electric Company, Schenectady, NY (US)

(72) Inventors: Keith Edward Massing, Mercer, PA (US); David Robert Furedy, Carnegie, PA (US)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 13/886,298

(22) Filed: May 3, 2013

(65) Prior Publication Data

US 2014/0326204 A1 Nov. 6, 2014

(51) Int. Cl.
*F01L 1/14* (2006.01)
*F01L 1/16* (2006.01)

(52) U.S. Cl.
CPC ... *F01L 1/16* (2013.01); *F01L 1/14* (2013.01); *F01L 2101/00* (2013.01); *F01L 2105/02* (2013.01)

(58) Field of Classification Search
CPC .. F01L 2105/00; F01L 2105/02; F16C 43/04; F16C 13/006
USPC ..... 123/90.15, 90.16, 90.39–90.59, 90.61
See application file for complete search history.

(56) References Cited

U.S. PATENT DOCUMENTS

| | | | | |
|---|---|---|---|---|
| 5,059,040 | A * | 10/1991 | Kadokawa | 384/448 |
| 6,056,442 | A * | 5/2000 | Ono et al. | 384/286 |
| 6,210,503 | B1 | 4/2001 | Naylor et al. | |
| 6,220,758 | B1 * | 4/2001 | Ono et al. | 384/286 |
| 6,679,210 | B2 | 1/2004 | Iijima | |
| 7,207,302 | B2 * | 4/2007 | Williams et al. | 123/90.48 |
| 2006/0126985 | A1 * | 6/2006 | Ochi et al. | 384/625 |

FOREIGN PATENT DOCUMENTS

| | | | |
|---|---|---|---|
| DE | 102007032990 | A1 * | 1/2009 |
| EP | 1574677 | A1 * | 9/2005 |
| WO | 8802059 | | 3/1988 |
| WO | WO 2008128825 | A1 * | 10/2008 |

OTHER PUBLICATIONS

Declaration under 37 C.F.R. Section 1.132 of Inventor Keith Massing, dated Sep. 12, 2013.

* cited by examiner

*Primary Examiner* — Thomas Denion
*Assistant Examiner* — Daniel Bernstein
(74) *Attorney, Agent, or Firm* — GE Global Patent Operation; John A. Kramer

(57) ABSTRACT

Various systems are provided for a cam follower of a cam follower system. In one embodiment, a cam follower of a cam system comprises a tappet positioned between a cylinder valve and a camshaft, the tappet configured to drive the cylinder valve, a roller, and a pin coated with a diamond-like carbon coating coupling the roller to the tappet, the pin having a depressed contour on an outer surface of the pin.

22 Claims, 6 Drawing Sheets

CAM FOLLOWER SYSTEM FOR ENGINE

FIELD

Embodiments of the subject matter disclosed herein relate to an engine, engine components, and an engine system, for example.

BACKGROUND

Engines may use a cam follower system to actuate cylinder valves in the engine. In such a system, a cylinder valve may be coupled through a pushrod to a cam follower. The cam follower may include a roller coupled through a pin to a tappet of the cam follower. A rotating camshaft may cause upward movement of the cam follower when a cam lobe on the camshaft contacts the roller of the cam follower. As a result, the pushrod is forced upward and actuates the cylinder valve. The pin of the cam follower may flex under a load of the pushrod actuating the cylinder valve. Additionally, when the pin flexes and/or the roller tilts, edge loading may occur on an outer surface of the pin at an interface between the roller and the pin. The edge loading may result in pin degradation and possible subsequent failure.

BRIEF DESCRIPTION

In one embodiment, a cam follower of a cam system comprises a tappet, a roller, and a pin. The tappet is positioned between a cylinder valve and a camshaft, and is configured to drive the cylinder valve. The pin couples the roller to the tappet. The pin has a depressed contour in an outer surface of the pin, e.g., the depressed contour may be symmetric and/or extend around a circumference of the pin.

In other embodiments, the pin is coated with a diamond-like carbon coating, e.g., at least part of the outer surface (such as the depressed contour) is coated with the diamond-like carbon coating.

In this way, the depressed contour on the outer surface of the pin may reduce edge loading and pin degradation.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of a cam follower pin contour for a cam follower system. The cam follower system includes a cylinder valve, a cam follower driving the cylinder valve, and a camshaft driving the cam follower. In one example, the cam follower may be coupled to the cylinder valve through a pushrod. The cam follower includes a pin coupling a roller to a tappet of the cam follower. The pin may include a depressed contour on the outer surface of the pin. The depressed contour may reduce edge loading due to concentrated contact between the pin and the roller. As a result, pin degradation may be reduced and the cam follower may be able to support increased loads.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV).

Figure 1:
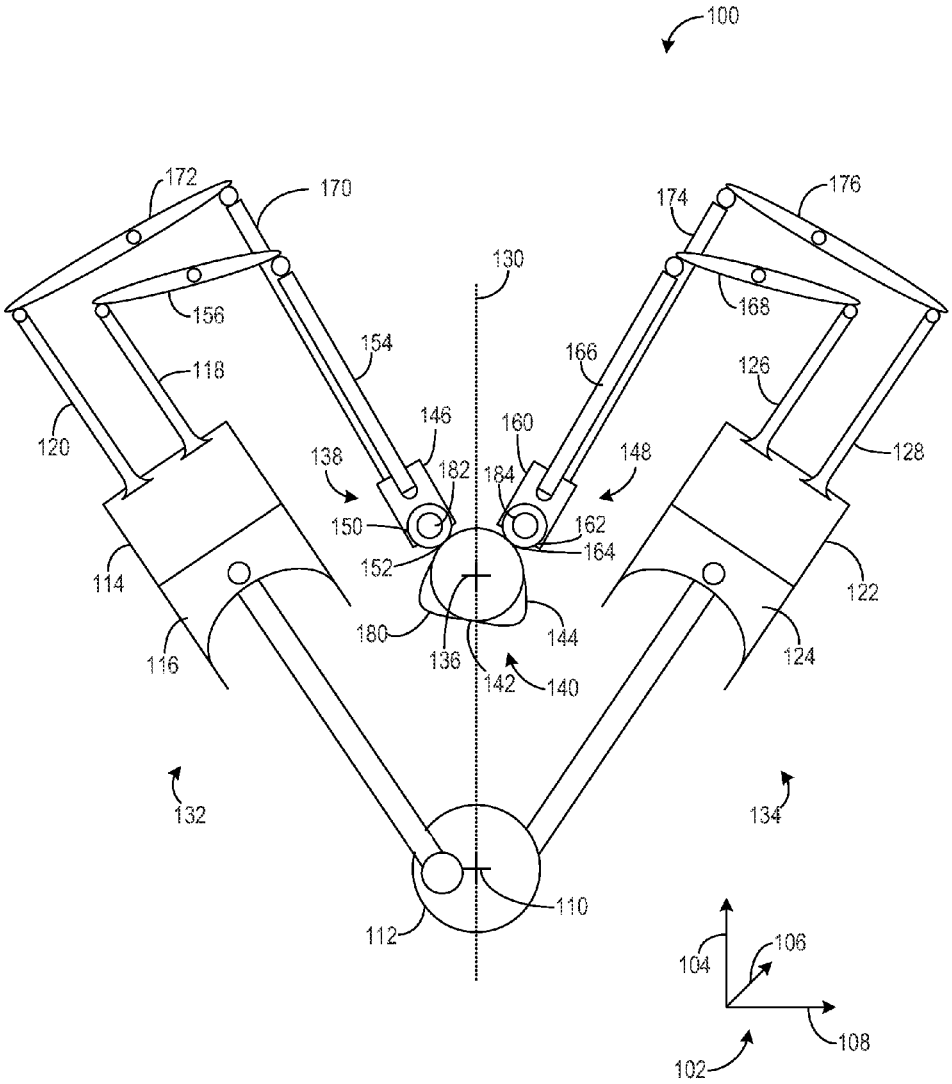
FIG. 1 shows a schematic diagram of a cam system in a V-engine according to an embodiment of the invention.

FIG. 1 shows a schematic diagram of an exemplary embodiment of an engine 100, such as an internal combustion engine. As shown in FIG. 1, engine 100 is a Vee engine (e.g., V-engine). FIG. 1 shows two cylinders out of multiple cylinders in the Vee engine. For example, the engine 100 may be a V-12 engine having twelve cylinders (two of the twelve shown in FIG. 1). In other examples, the engine 100 may be a V-6, V-8, V-10, V-16, I-4, I-6, I-8, opposed 4, or another engine type.

A coordinate axis 102 is shown depicting a vertical axis 104, a lateral axis 106, and a horizontal axis 108. As shown in FIG. 1, engine 100 is a Vee type engine in which the cylinders and pistons are aligned, in two separate planes or banks, so that they appear to be in a "V" when viewed along the lateral axis 106 (e.g., into the page).

FIG. 1 shows two cylinders of engine 100. A first cylinder 114 is shown with a first piston 116 and two cylinder valves 118 and 120. In one example, the two cylinder valves 118 and 120 may be a first intake valve 118 and a first exhaust valve 120. A second cylinder 122 is shown with a second piston 124 and two cylinder valves 126 and 128. In one example, the two cylinder valves 126 and 128 may be a second intake valve 126 and a second exhaust valve 128. In alternate examples, the first cylinder 114 and the second cylinder 122 may have more or less than two cylinder valves each. For example, the first cylinder 114 and the second cylinder 122 may each have one or four cylinder valves.

As shown in FIG. 1, the first cylinder 114 is part of a first bank of cylinders 132 (e.g., first bank) to the left of a vertical axis 130 of a crankshaft 112. Thus, the first bank 132 may be referred to as the left bank. The second cylinder 122 is part of a second bank of cylinders 134 (e.g., second bank) to the right of the vertical axis 130 of the crankshaft 112. Thus, the second bank 134 may be referred to as the right bank.

The first piston 116 and the second piston 124 are coupled to the crankshaft 112 so that reciprocating motion of the pistons is translated into rotational motion of the crankshaft around an axis of rotation 110. In some embodiments, the engine may be a four-stroke engine in which each of the cylinders fires in a firing order during two revolutions of the crankshaft 112. In other embodiments, the engine may be a two-stroke engine in which each of the cylinders fires in a firing order during one revolution of the crankshaft 112.

The first intake valve 118 controls the intake air entering the first cylinder 114 from an intake manifold of the engine 100 for combustion. As such, when the first intake valve 118 is actuated, intake air enters the first cylinder 114. Similarly, the second intake valve 126 controls the intake air entering the second cylinder 122. The first exhaust valve 120 controls the flow of exhaust gases from combustion exiting the first cylinder 114 and traveling to an exhaust manifold of the engine 100. Similarly, the second exhaust valve 128 controls the flow of exhaust exiting the second cylinder 122.

The timing of the intake and/or exhaust valves is controlled by a cam follower system 140 (e.g., cam system). The cam follower system 140 includes a camshaft 142 driven by the rotation of the crankshaft 112 around the axis of rotation 110. The camshaft 142 is rotatable around an axis of rotation 136 of the camshaft. The camshaft 142 may be the single, or only, camshaft for engine 100 and is centrally located between the left bank 132 and the right bank 134 on the vertical axis 130. In alternate embodiments, the engine 100 may have more than one camshaft 142 controlling individual cylinder banks and/or groups of cylinders.

As shown in FIG. 1, the camshaft 142 extends in a lateral direction along the lateral axis 106, along the length of the cylinder banks. A plurality of cam lobes may be disposed along the length of the camshaft 142, such as a first cam lobe 144 and a second cam lobe 180. In the example shown in FIG. 1, the second cam lobe 180 is positioned behind, in the direction of the lateral axis 106, the first cam lobe 180. In some examples, the camshaft 142 may have one cam lobe for every intake and exhaust valve of the engine (e.g., or for every cylinder valve of the engine)

The cam follower system 140 further includes a plurality of cam followers. For example, FIG. 1 shows a first cam follower 138 and a second cam follower 148. Each cam follower drives a cylinder valve. As shown in FIG. 1, each cam follower drives a pushrod coupled through a rocker to either an intake or exhaust valve. As such, movement of each cam follower may drive the actuation of the cam follower's respective cylinder valve.

The first cam follower 138 includes a first tappet 146, or cam follower body, a first roller 150, and a first pin 182. The first pin 182 couples the first roller 150 to the first tappet 146. The first roller 150 rotates around the first pin 182 and contacts the camshaft 142 at a first contact point 152. The first tappet 146 is further coupled to a first end of a first pushrod 154. The first pushrod 154 is coupled at a second end to a first rocker 156. The first rocker 156 is further coupled to the first intake valve 118. In alternate embodiments, the first pushrod 154 may be coupled to the first intake valve 118 (or another cylinder valve) through a different type of element.

Similarly, the second cam follower 148 includes a second tappet 160, or cam follower body, a second roller 162, and a second pin 184. The second pin 184 couples the second roller 162 to the second tappet 160. The second roller 162 rotates around the second pin 184 and contacts the camshaft 142 at a second contact point 164. The second tappet 160 is further coupled to a first end of a second pushrod 166. The second pushrod 166 is coupled at a second end to a second rocker 168. The second rocker 167 is further coupled to the second intake valve 126. In alternate embodiments, the second pushrod 166 may be coupled to the second intake valve 126 (or another cylinder valve) through a different type of element. Further details on the cam follower assembly are shown in FIGS. 2-5 and described further below.

A third cam follower and third roller may be located behind, in the lateral direction, the first cam follower 148 and the first roller 150. The third roller may be coupled to a first end of a third pushrod 170. The third pushrod 170 is coupled at a second end to a third rocker 172. The third rocker 172 is further coupled to the first exhaust valve 120.

Similarly, a fourth cam follower and fourth roller may be located behind, in the lateral direction, the second cam follower 148 and the second roller 162. The fourth roller may be coupled to a first end of a fourth pushrod 174. The fourth pushrod 174 is coupled at a second end to a fourth rocker 176. The fourth rocker 176 is further coupled to the second exhaust valve 128.

FIG. 1 shows one cylinder on each bank. However, as discussed above, engine 100 may have a plurality of cylinders on each bank, each with like components to those shown in FIG. 1. Each valve of each cylinder may be driven by a cam follower.

Figure 2:
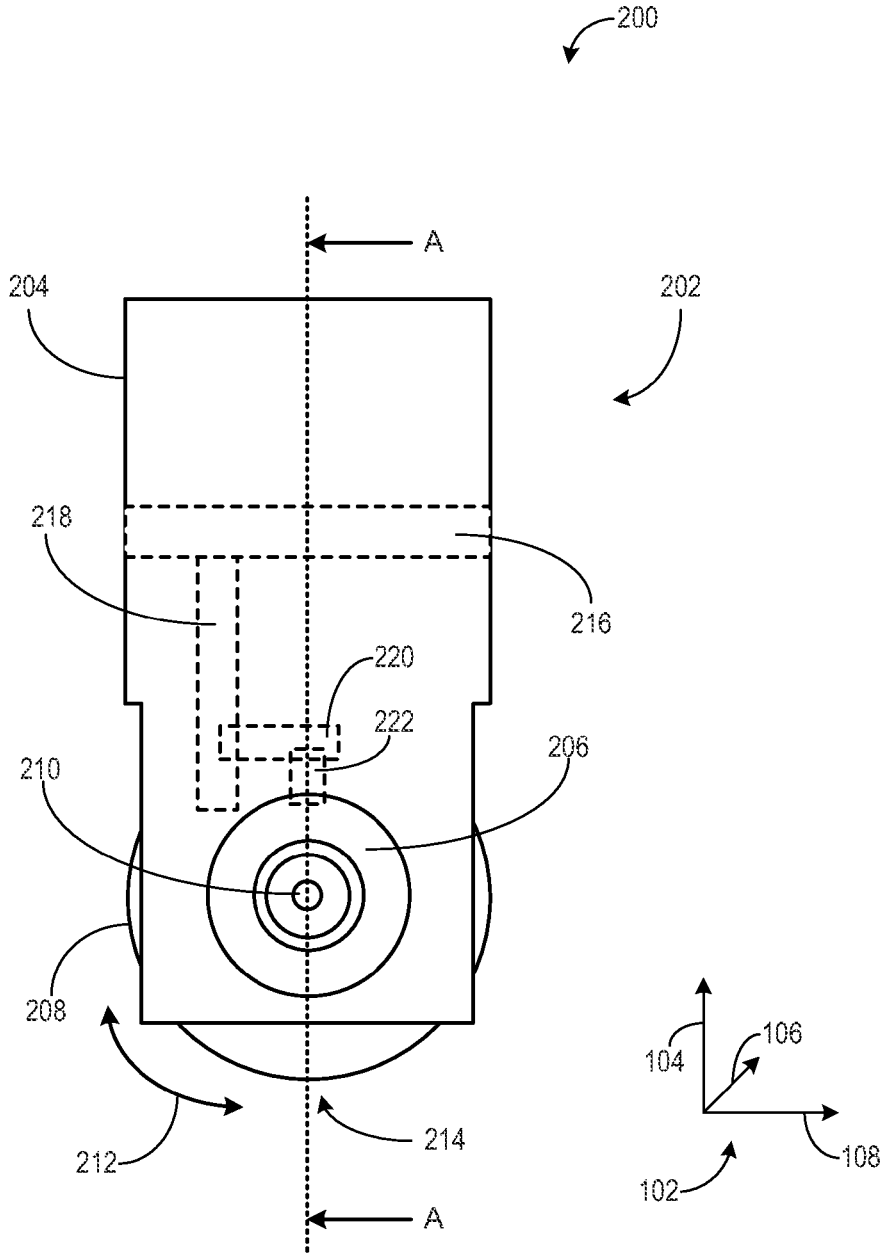
FIG. 2 shows a schematic diagram of front view of a cam follower according to an embodiment of the invention.

FIG. 2 shows a schematic 200 of a front view of a cam follower 202, such as the first cam follower 138 or the second cam follower 148 shown in FIG. 1. The cam follower 202 comprises a tappet 204 (such as the first tappet 146 or second tappet 160 shown in FIG. 1), a pin 206 (such as the first pin 182 or second pin 184 shown in FIG. 1), and a roller 208 (such as the first roller 150 or second roller 162 shown in FIG. 1). The tappet 204 may also be referred to as a lifter or cam follower body.

As shown in FIG. 1, FIG. 2 includes the coordinate axis 102 showing the vertical axis 104, the lateral axis 106, and the horizontal axis 108. The roller 208 rotates about a central axis or center 210 of the pin 206 in a direction shown by arrow 212. For example, the rotation direction may be clockwise or counterclockwise, based on a rotation direction of the camshaft (such as the camshaft 142 shown in FIG. 1). In this way, the center 210 of the pin 206 may be an axis of rotation for the roller 208. The camshaft 142 contacts the roller 208 at a bottom point 214 in the roller's rotation.

The cam follower 202 further includes oil passages 216 and 218 for lubricating the components of the cam follower 202. Oil is fed into an internal drilling/oil passage 220 where it flows into an intersecting oil passage 222. The oil passage 222 is aligned with the oil passage 332 shown in FIG. 3. As described later with regard to FIG. 3, oil flows through the oil passage 332 inside the pin 206 to the oil passage 334. The oil passage 334 opens on each side of the pin to provide oil to the surface of the pin 206 between the pin 206 and the roller 208.

Figure 3:
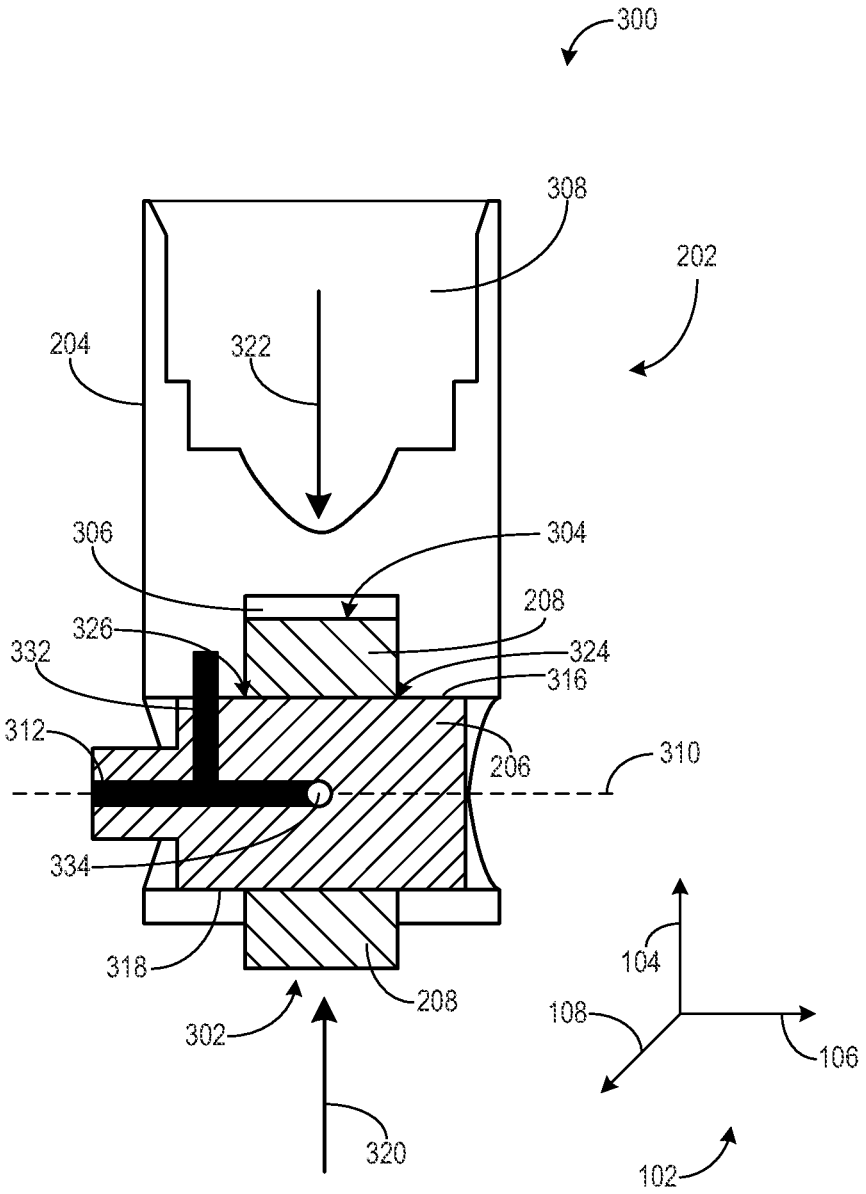
FIG. 3 shows a schematic diagram of a side section view of a cam follower according to an embodiment of the invention.

FIG. 3 shows a schematic 300 of a cross-section of FIG. 2 along axis A-A of the cam follower 202. As shown in FIG. 3, the pin 206 couples the roller 208 to the tappet 204. A bottom surface 302 (e.g., bottom outer surface) of the roller 208 contacts the camshaft (as shown in FIG. 1). A top surface 304 of the roller 208 is within the tappet 204 and proximate to a pushrod and cylinder valve. A distance between the bottom surface 302 and the top surface 304 of the roller 208 may be an outer diameter of the roller 208. A space 306 is provided for clearance between the top surface 304 of the roller 208 and the tappet 204. The space 306 allows the roller 208 to freely rotate around a central axis 310 of the pin 206 without hitting the tappet 204.

As discussed above with regard to FIG. 2, oil is fed into the oil passage 220 and then flows into the intersecting oil passage 222. The oil passage 222 is aligned with the oil passage 332. Oil flows through the oil passage 332 inside the pin 206 to the oil passage 334. The oil passage 334 opens on each side of the pin to provide oil to the surface of the pin 206 between the pin 206 and the roller 208. The pin 206 further includes an oil feed passage 312. Oil may be supplied to the oil feed passage 312 from the oil passage 222 in the tappet 204 and distributed to the outside diameter of the pin through the oil passage 334 to the interface between the pin 206 and the roller 208. Oil feed passage 312 may be aligned with the central axis 312. Further, the pin 206 has a cylindrical shape and circular cross-section. An outer surface of the pin 206 includes a top side 316 and a bottom side 318. A distance between the top side 316 and the bottom side 318 may be a diameter of the pin 206. An inner surface of the roller 208 rotates around and may contact an outer surface of the pin 206. The roller 208 may contact the outer surface of the pin 206 all the way around a circumference of the pin 206. Further, an inner diameter of the roller 208 may be slightly larger than the diameter or the pin 206 to allow free rotation of the roller 208 around the pin 206.

The tappet 204 includes a cup 308 for holding a first end of a pushrod (such as the first pushrod 154 or the second pushrod 166 shown in FIG. 1). As shown in FIG. 1, the pushrod is coupled to a cylinder valve at a second end of the pushrod. Thus, upward movement, in the direction of the vertical axis 104, of the cam follower 202 results in upward movement of the pushrod and subsequent actuation of the cylinder valve. Specifically, a cam lobe of the camshaft (such as the first cam lobe 144 or the second cam lobe 180 of the camshaft 142) may contact the bottom surface 302 of the roller 208, thereby causing the roller 208, the cam follower 202, and the pushrod to move upward in the direction shown by arrow 320. A subsequent reaction force of the pushrod on the cam follower 202 is shown by arrow 322.

The top side 316 of the pin 206 is proximate to the cup 308 of the tappet 204 while the bottom side 318 is proximate to the camshaft. As such, the reaction force may cause loading on the outer surface of the pin. In some examples, this loading may be greatest at the top side 316 and the bottom side 318 of the pin 206. For example, the inner surface of the roller 208 may contact and cause loading on the top side 316 and/or the bottom side 318 of the pin 206. In other examples, loading may occur on the outer surface of the pin 206, all the way around the circumference of the pin 206 (e.g., on the entire outer surface of the pin 206).

Edge loading may occur as the pin flexes under the reaction force at the interface between outer edges of the inner surface of the roller 208 and the outer surface of the pin 206. Two potential edge loading points on the top side 316 of the pin 206 are shown at point 324 and point 326. Similar edge loading points may occur at the bottom side 318 and/or other positions on the outer surface of the pin 206. Edge loading may also occur or increase when the roller tilts or angles with respect to the vertical axis 104. An example of the roller tilting is shown in FIG. 6.

Figure 6:
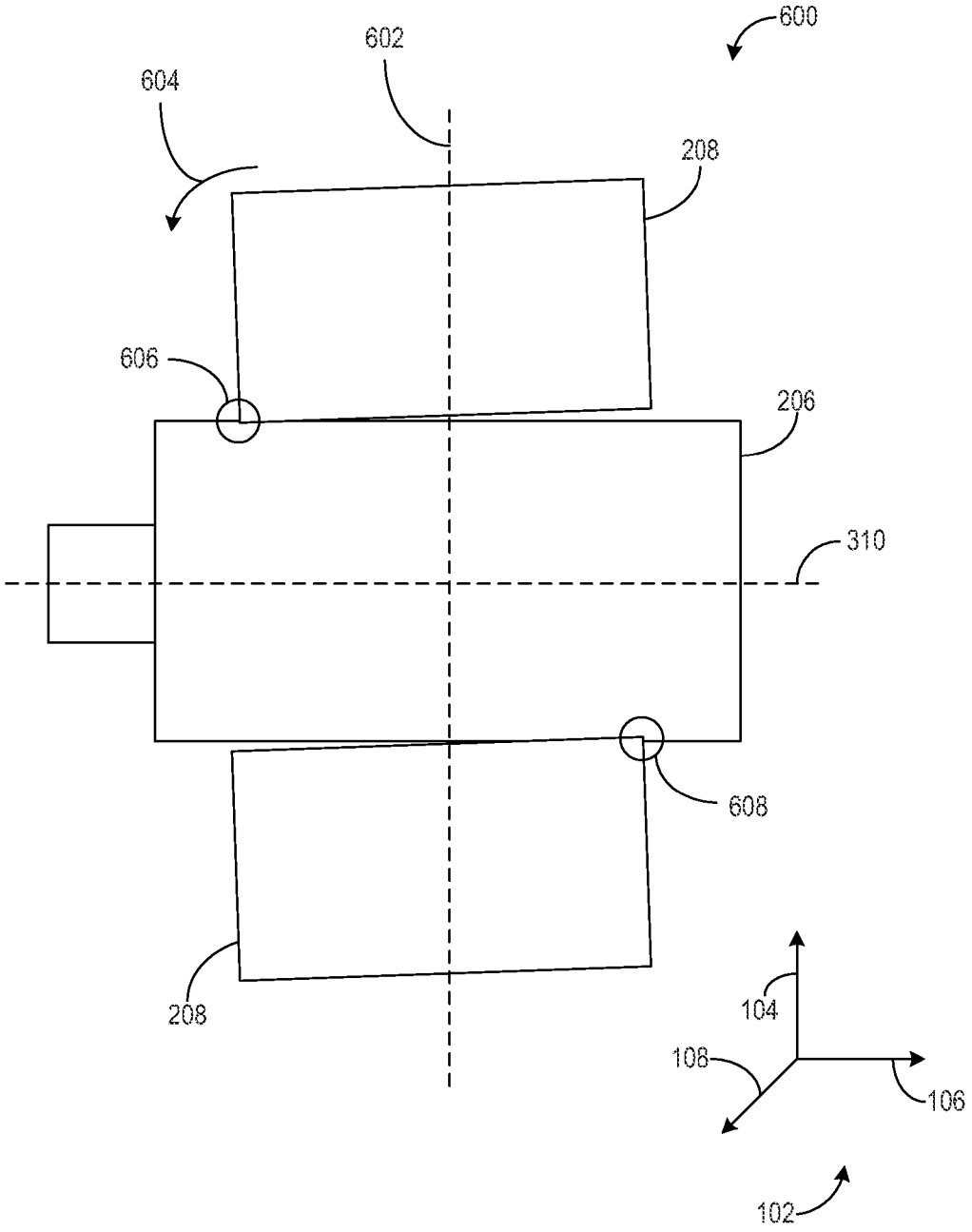
FIG. 6 shows a schematic diagram of a cam follower pin and roller in a tilted configuration.

FIG. 6 shows a schematic 600 of the pin 206 and the roller 208 of the cam follower, as described above. During operation, the roller 208 of the cam follower may tilt or rotate with respect to a vertical axis 602 of the roller 208. As shown in FIG. 6, the roller 208 rotates counterclockwise from the vertical axis 602, in the direction shown by arrow 604. As a result, the edges of the roller 208 may contact and apply pressure on the outer surface of the pin 206. The load of the roller 208 (and the cam follower assembly) is then concentrated at the contact points 606 and 608 of the outer surface of the pin 206. Edge loading of the pin in this way may cause pin degradation. In some cases, the pin 206 may experience excessive loading and subsequent failure.

Further, during manufacturing, burs may form on the corners and/or edges of the roller. The burs may further increase wear or degradation of the pin. Additionally, particles and/or wear debris from the engine may become stuck between the pin and roller. For a pin with a flat contour (e.g., no depressed contour, as shown in FIG. 3), these particles may also increase pin wear and degradation.

Additionally, during operation, the cam follower may develop a hydrodynamic oil film wedge between the roller 208 and the pin 206. The dynamics of the wedge are such that the pressure of the oil is highest at the vertical axis 602. The hydrodynamics may be such that the pressure is sufficient to deform the roller 208 and pin 206 with greatest deformation at the vertical axis 602 and then tapering to the minimum deformation at the contact points 606 and 608.

As shown in FIGS. 2-3, the outer surface of the pin is relatively uniform with a flat contour. As such, a cross-section of the pin is circular. In order to reduce edge loading on the pin, a depressed contour may be created on the outer surface of the pin. The depressed contour may result in a non-uniform contour along a length of the pin. Additionally, the depressed contour may provide room to flush particles and/or wear debris out from between the roller and the pin, through oil passages in the pin (such as the oil feed passages 312 and 314 shown in FIG. 3).

Figure 4:
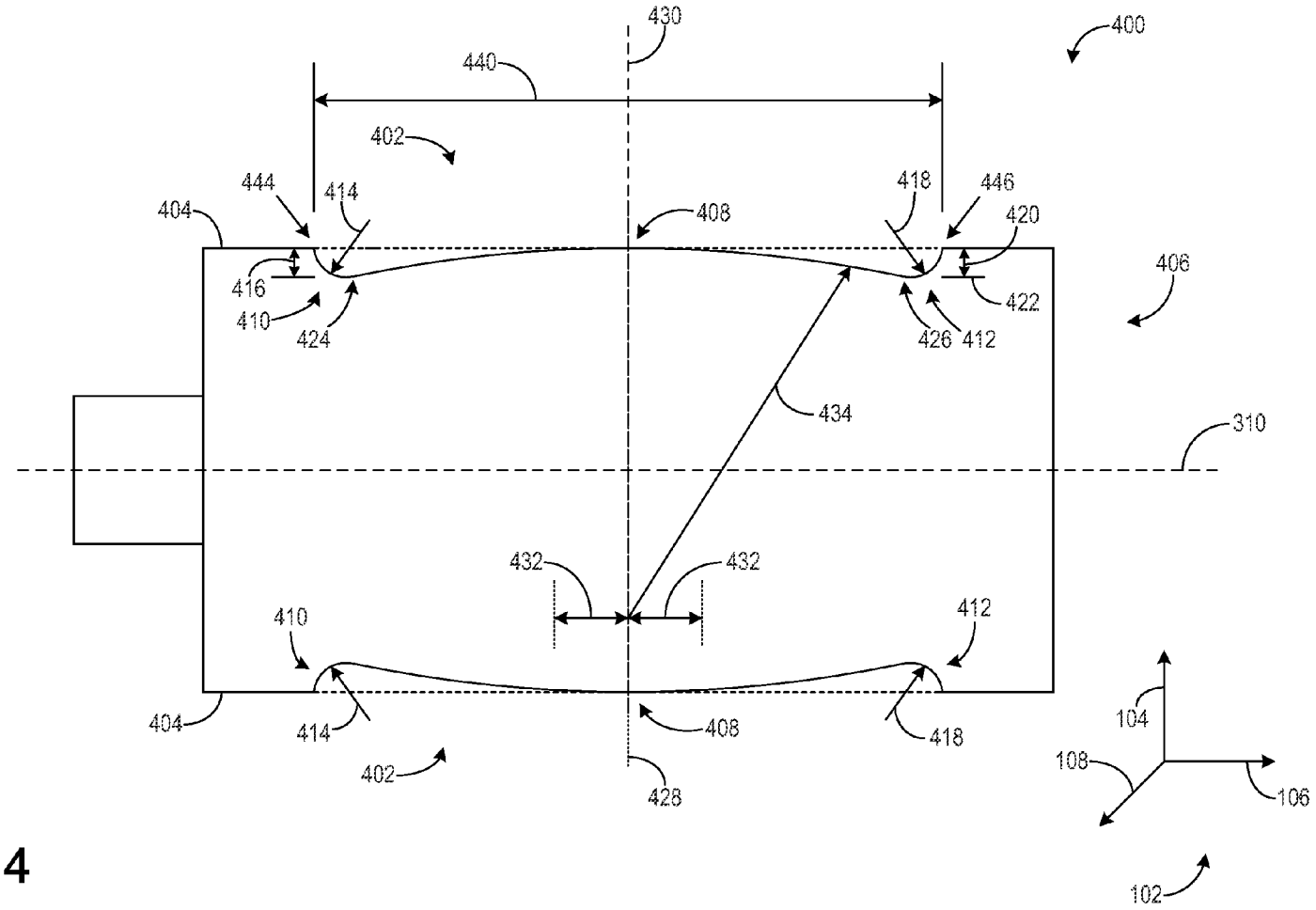
FIG. 4 shows a schematic diagram of an exaggerated cam follower pin contour according to an embodiment of the invention.

FIG. 4 shows a schematic 400 of an exaggerated pin contour for a cam follower (such as the cam follower 202 shown in FIGS. 2-3). As such, the schematic 400 is not to scale and shows relative dimensions of the pin contour. For example, the scale of the pin contour is exaggerated with respect to the scale of the pin.

Schematic 400 shows a depressed contour 402 on an outer surface 404 of a pin 406. Schematic 400 shows a side cross-section of the pin 406 which shows the depressed contour at a top and bottom of the pin 406. However, the depressed contour 402 extends all the way around a circumference of the pin 406. Specifically, the depressed contour 402 is on the entire outer surface 404 of the pin and extends continuously around the pin 406, in a circumferential direction.

The depressed contour includes a crown 408 between a first curved end 410 and a second curved end 412. The first curved end 410 and the second curved end 412 may also be referred to as recessed ends. As such, the depressed contour includes two recessed ends. The first curved end 410 has a first radius 414 and a first height 416. The second curved end 412 has a second radius 418 and a second height 420. The first radius 414 and the second radius 418 are substantially equal. The first radius 414 and the second radius 418 may be within a range of 2-6 mm. In one example, the first radius 414 and the second radius 418 may be 2 mm. In another example, the first radius 414 and the second radius 418 may be 4 mm. The first radius 414 and the second radius 418 may be based on a third radius 334 (discussed below), a length 430 of the depressed contour 402, and the first height 416 and the second height 420. In an alternate example, the first radius 414 and the second radius 418 may be within a range of 1-20 mm.

The first height 416 and the second height 420 are substantially equal and defined from a bottom of the depressed contour to the outer surface 404 of the pin 406. For example, the outer surface 404 of the pin is at a first level and the two recessed ends are at a second level 422, the second level 422 being closer to the central axis 310 of the pin 406 than the first level. As such, first curved end 410 and the second curved end 412 are recessed inward, toward the central axis 310 of the pin, from the outer surface of the pin. The first height 416 and the second height 420 may be within a range of 4-16 μm. In one example, the first height 416 and the second height 420 may be 6 μm. In another example, the first height 416 and the second height 420 may be 14 μm. The first height 416 and the second height 420 may be based on width of the roller 208 of the cam follower (such as the first width 508 shown in FIG. 5).

As such, as the width of the roller increases, the first height 416 and the second height 420 may increase.

The crown 408 transitions to the first curved end 410 through a first tangential transition 424. Similarly, the crown 408 transitions to the second curved end 412 through a second tangential transition 426. The crown 408 is positioned at a center 428 of the depressed contour 402, between the two recessed ends (e.g., first curved end 410 and second curved end 412). Further, a top of the crown 408 is tangent to the outer surface 404 of the pin 406. For example, the top of the crown 408 is at a level substantially the same as the first level of the outer surface 404. In this way, the depressed contour 402 is depressed by a greater amount at the two recessed ends than in the center 428 of the depressed contour, at the crown.

The crown 408 has a third radius 434. Thus, the depressed contour 402 transitions from the first radius 414 to the third radius 434 through the first tangential transition 424. Similarly, the depressed contour 402 transitions from the second radius 418 to the third radius 434 through the second tangential transition 426. The third radius 434 may be within a range of 6500-8000 mm. In one example, the third radius 434 may be 7626 mm. In another example, the third radius 434 may be 6500 mm.

The third radius 434 of the crown 408 is defined from a centerline or center 428 of the depressed contour 402. The center 428 of the depressed contour is the same as the centerline of the crown 408. As such, the depressed contour is symmetric. Specifically, the crown 408 is symmetric about the center 428 of the depressed contour 402. The centerline of the crown 408 and subsequently the center 428 of the depressed contour 402 is positioned within a distance 432 of a centerline 430 of the pin 406. The centerline 430 of the pin and the center 428 of the depressed contour 402 are both perpendicular to the central axis 310, or axis of rotation of the pin 406.

For example, the center 428 of the depressed contour 402 may be within the distance 432 to the right or to the left of the centerline 430 of the pin 406. In one example, the center 428 of the depressed contour 402 may be positioned to the right of the centerline 430 by the distance 432. In this example, the depressed contour 402 may be closer to a right end of the pin 406 than the left end of the pin 406, the right and left ends relative to the centerline 430. The distance 432 may be within a range of 0.5-1.5 mm. In one example, the distance 432 may be 1 mm. In this example, the center 428 of the depressed contour 402 may be within 1 mm to the right or to the left of the centerline 430. In another example, the distance 432 may be 0.5 mm.

As shown in FIG. 4, the pin 406 further includes a first transition 444 between the outer surface 404 of the pin 406 and the first curved end 410 of the depressed contour 402. Similarly, the pin 406 includes a second transition 446 between the outer surface 404 of the pin 406 and the second curved end 412 of the depressed contour 402. The first transition 444 has a fourth radius and the second transition 446 has a fifth radius, the fourth radius and the fifth radius being substantially equal. The fourth radius and the fifth radius may be within a range of 0.1-0.3 mm. In one example, the fourth and the fifth radius may be 0.2 mm. In another example, the fourth and the fifth radius may be 0.25 mm.

Further, the depressed contour 402 has a length 440, defined between the two recessed ends and centered within the distance 432 of the centerline 430 of the pin 406. Specifically, the depressed contour 402 is positioned at a center portion along a length 442 of the pin 406. The center portion is defined such that the center 428 of the depressed contour 402 is proximate to the centerline 430 of the pin and the first curved end 410 and the second curved end 412 are positioned away, or a distance from the ends (e.g., right and left end) of the pin 406. The length 440 of the depressed contour 402 is smaller than the length 442 of the pin 406. The length 440 may be within a range of 22-26 mm. In one example, the length 440 may be 25 mm. In another example, the length 440 may be 23 mm.

In some embodiments, the depressed contour 402 may be depressed less or more than shown in FIG. 4 from the outer surface 404. For example, the crown 408 may have a larger radius, making the crown flatter near the center of the crown 408. The first height 416 and the second height 420 may be smaller, thereby resulting in less depression at the two recessed ends. In another embodiment, the crown may be flatter near the center of the depressed contour 402 while the first curved end 410 and the second curved end 412 remain at the first height 416 and the second height 420. This may result in more severe transitions between the curved ends and the crown.

The pin 406 may be coated with a coating to decrease wear and reduce degradation. For example, the pin 406 may be coated with a diamond-like carbon (DLC) coating. The DLC coating is an amorphous carbon-based coating, comprising carbon in which the bonding may be formed by carbon atoms bonded generally into the well-known diamond bond, having predominantly sp3 tetrahedral bonds. The DLC coating may have a relatively high hardness and a relatively low coefficient of friction. The DLC coating may be thin (e.g., 1-2 μm), and is provided to reduce wear and friction between the pin and the roller. In this way, the DLC coated pin may result in less pin degradation and increased longevity and load tolerance of the pin.

Figure 5:
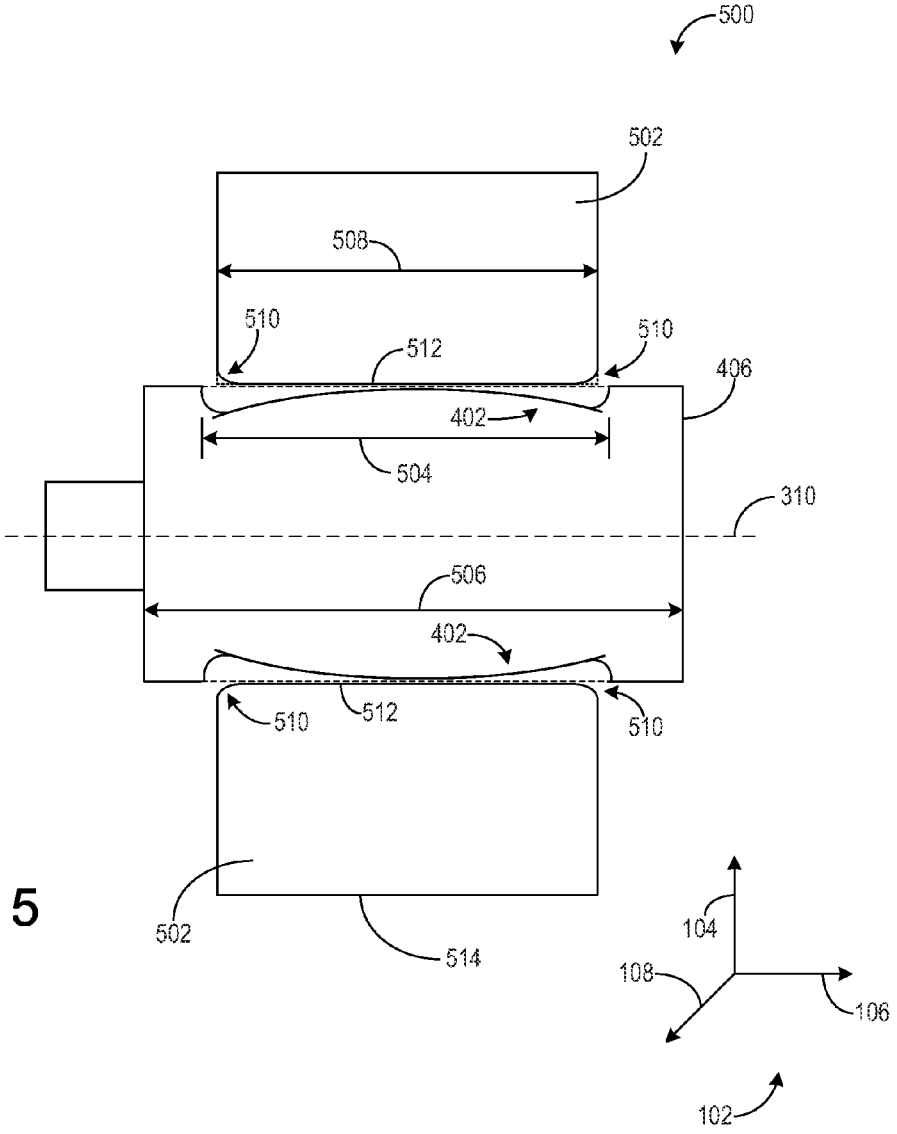
FIG. 5 shows a schematic diagram of an interface between a cam follower pin and roller according to an embodiment of the invention.

FIG. 5 shows a schematic 500 of an interface between the pin 406, shown in FIG. 4, and a roller of a cam follower. Specifically, the schematic 500 shows the pin 406 with the depressed contour 402, as discussed above with reference to FIG. 4. The schematic 500 also shows a roller 502. The pin 406 may couple the roller 502 to a cam follower, as shown in FIGS. 1-3. As discussed above, the roller 502 rotates about the pin 406, around the central axis 310. Further, the roller 502 contacts the camshaft on an outer surface 514 of the roller 502 while contacting the pin 406 at an inner surface 512 of the roller 502.

The pin 406 and the roller 502 may both be comprised of one or more steel materials. Specifically, in one example, the pin 406 and the roller 502 may both be comprised entirely of a steel material. Further, as discussed above, the pin 406 may be coated on its exterior with a diamond-like carbon (DLC) coating. The DLC coating may be over an entire depressed outer surface of the pin. As such, the steel pin 406 and the steel roller 502 may contact one another at an interface, the interface defined between the inner surface 512 of the roller 502 and the outer surface 404 of the pin 406. As such, the steel inner surface of the roller 502 may directly contact the DLC-coated outer surface of the (steel) pin 406. In one example, the roller 502 does not include an outer DLC coating.

The depressed contour 402 has a first length 504, the pin 406 has a second length 506, and the roller has a first width 508. The first length 504, the second length 506, and the first width 508 are defined in a direction of the central axis 310 of the pin 406 (e.g., in a direction of the lateral axis 106). The first length 504 of the depressed contour 402 is shorter than the second length 506 of the pin 406 and longer than the first width 508 of the roller 502.

The roller 502 includes a fillet 510 or curved edge on an outside edge of the inner surface 512 of the roller 502. The fillet 510 may have a radius in a range of 1-2 mm. In one example, the radius of the fillet 510 may be 1.5 mm. In another example, the radius of the fillet 510 may be 2 mm. The fillet may further reduce edge loading of the roller 502 on the pin 406. As shown in FIG. 5, the recessed ends of the depressed contour 402 may be positioned proximate to the outside edges of the inner surface of the roller. This may reduce edge loading from reaction forces on the cam follower and/or tilting or linear movement of the roller.

As described above, a cam follower may include a pin coupling a roller to a tappet of the cam follower. The pin may include a depressed contour on an outer surface of the pin, around the circumference of the pin. The depressed contour may include a crown centered between two recessed ends. Further, the depressed contour may be recessed from an outer surface of the pin. Specifically, the depressed contour may be depressed or recessed to a greater extent at the ends (e.g., recessed ends) of the depressed contour than at the center of the depressed contour, at the crown. Additionally, the recessed ends of the depressed contour may be proximate to outer edges of the roller. In this way, the depressed contour on the outer surface of the pin may reduce degradation of the pin due to edge and other loading while increasing a load the pin may be able to support.

An embodiment relates to a cam follower of a cam follower system comprising a tappet between a cylinder valve and a camshaft, the tappet driving the cylinder valve, a roller, and a pin coupling the roller to the tappet, the pin having a depressed contour around a circumference of the pin. The depressed contour includes a crown between a first curved end and a second curved end of the depressed contour. The first curved end has a first radius and a first height and the second curved end has a second radius and a second height, the first height and the second height being the same and defined from a bottom of the depressed contour to an outer surface of the pin and the first radius and the second radius being the same. The crown transitions to the first curved end through a first tangential transition and the crown transitions to the second curved end through a second tangential transition. Further, the outer surface of the pin is tangent to a top of the crown. The depressed contour has a first length, the pin has a second length, and the roller has a first width, the first length, the second length, and the first width defined in a direction of a central axis of the pin, the first length being shorter than the second length and longer than the first width. Additionally, the crown has a third radius defined from a centerline of the crown, the centerline of the crown positioned within a distance of a centerline of the pin. The tappet of the cam follower includes a cup for holding a first end of a pushrod, the pushrod coupled to the cylinder valve at a second end of the pushrod. The roller of the cam follower rotates about the pin and contacts the camshaft on an outer surface of the roller. The roller includes a fillet on an outside edge of an inner surface of the roller. Additionally, the pin is coated with a diamond-like carbon coating.

Another embodiment relates to a cam follower system comprising a cylinder valve, a cam follower driving the cylinder valve, the cam follower including a pin coupling a roller to a tappet, the pin having a symmetric depressed contour on an outer surface of the pin, and a camshaft driving the cam follower. The depressed contour is positioned at a center portion along a length of the pin and extends around a circumference of the pin. The depressed contour includes two recessed ends, the two recessed ends recessed from the outer surface of the pin. The depressed contour further includes a crown, the crown positioned at a center of the depressed contour, between the two recessed ends, and the crown being tangent to the outer surface of the pin. Further, the depressed contour is depressed by a greater amount at the two recessed ends than in the center of the depressed contour, at the crown. Additionally, the two recessed ends have a first radius and the crown has a second radius and wherein the depressed contour transitions from the first radius to the second radius through a tangential transition. The depressed contour has a length, defined between the two recessed ends and centered within a distance of a centerline of the pin.

A further embodiment relates to a system comprising an engine with a camshaft, a cam follower operative to be driven by the camshaft through a roller of the cam follower, the cam follower having a pin coupling the roller to a tappet of the cam follower, the pin having a depressed contour on an outer surface of the pin, a cylinder valve operative to be driven by the cam follower, and a pushrod coupled between the tappet of the cam follower and the cylinder valve. The depressed contour includes a crown tangent to the outer surface of the pin, the crown decreasing from the outer surface of the pin to a first curved end and a second curved end of the depressed contour, the first curved end and the second curved end recessed by an amount from the outer surface of the pin.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A cam follower of a cam follower system, comprising:

a tappet positioned between a cylinder valve and a camshaft, the tappet configured to drive the cylinder valve;

a roller; and a pin coated with a diamond-like carbon coating coupling the roller to the tappet, the pin having a depressed contour on an outer surface of the pin at a portion along a length of the pin where the outer surface interfaces with an inner surface of the roller, wherein the depressed contour includes a crown between a first curved end and a second curved end of the depressed contour and wherein the first curved end and the second curved end are positioned away from ends of the pin.

2. The cam follower of claim 1, wherein the first curved end has a first radius and a first height and the second curved end has a second radius and a second height, the first height and the second height being the same and defined from a bottom of the depressed contour to the outer surface of the pin, and the first radius and the second radius being the same.

3. The cam follower of claim 2, wherein the crown transitions to the first curved end through a first tangential transition and the crown transitions to the second curved end through a second tangential transition.

4. The cam follower of claim 2, wherein the outer surface of the pin is tangent to a top of the crown.

5. The cam follower of claim 1, wherein the depressed contour is positioned along the length of the pin, the length perpendicular to a diameter of the pin, and wherein the depressed contour has a first length, the pin has a second length, and the roller has a first width, the first length, the second length, and the first width defined in a direction of a central axis of the pin, the first length being shorter than the second length and longer than the first width.

6. The cam follower of claim 1, wherein the crown has a third radius defined from a centerline of the crown, the centerline of the crown positioned within a distance of a centerline of the pin.

7. The cam follower of claim 1, wherein the tappet includes a cup for holding a first end of a pushrod, the pushrod coupled to the cylinder valve at a second end of the pushrod.

8. The cam follower of claim 1, further comprising oil passages including a first oil passage which opens on each side of the pin to provide oil to the outer surface of the pin between the pin and the roller, wherein the roller is configured to rotate about the pin and contacts the camshaft on an outer surface of the roller, and wherein the inner surface of the roller rotates around and contacts the outer surface of the pin through a hydrodynamic oil film wedge formed between the inner surface of the roller and the outer surface of the pin.

9. The cam follower of claim 1, wherein the roller includes a fillet on an outside edge of the inner surface of the roller.

10. The cam follower of claim 1, wherein the outer surface of the pin is coated with the diamond-like carbon coating, wherein the pin and the roller are comprised of one or more steel materials, and wherein a steel inner surface of the roller contacts the diamond-like carbon-coated outer surface of the pin.

11. The cam follower of claim 1, wherein the outer surface of the pin faces the inner surface of the roller and wherein the depressed contour extends around a circumference of the pin.

12. A cam follower system, comprising:

a cylinder valve;

a cam follower configured to drive the cylinder valve, the cam follower including a pin coated with a diamond-like carbon coating coupling a roller to a tappet, the pin having a depressed contour on an outer surface of the pin, the depressed contour positioned at a center portion along a length of the pin, the length parallel to a central axis of the pin, where the roller is configured to rotate about the central axis of the pin; and a camshaft configured to drive the cam follower, wherein the depressed contour extends around a circumference of the pin and wherein the depressed contour includes two recessed ends, the two recessed ends recessed from the outer surface of the pin and positioned a distance away from ends of the pin.

13. The cam follower system of claim 12, wherein the pin and roller are comprised of one or more steel materials, and wherein the depressed contour is symmetric.

14. The cam follower system of claim 12, wherein the cam follower includes a plurality of oil passages, the plurality of oil passages including a first oil passage in the tappet aligned with a second oil passage in the pin, where oil is supplied from the first oil passage, to the second oil passage and to the outer surface of the pin and an interface between the pin and roller.

15. The cam follower system of claim 12, wherein the depressed contour further includes a crown, the crown positioned at a center of the depressed contour, between the two recessed ends, and the crown being tangent to the outer surface of the pin.

16. The cam follower system of claim 15, wherein the depressed contour is depressed by a greater amount at the two recessed ends than in the center of the depressed contour, at the crown.

17. The cam follower system of claim 15, wherein the two recessed ends have a first radius and the crown has a second radius and wherein the depressed contour transitions from the first radius to the second radius through a tangential transition.

18. The cam follower system of claim 12, wherein the depressed contour has a second length, defined between the two recessed ends and centered within a distance of a centerline of the pin, where the second length of the depressed contour is shorter than the length of the pin.

19. An engine comprising the cam follower system of claim 12.

20. A system, comprising:

an engine with a camshaft;

a cam follower operative to be driven by the camshaft through a roller of the cam follower, the cam follower having a pin coupling the roller to a tappet of the cam follower, the pin coated with a diamond-like carbon coating, the pin having a depressed contour on an outer surface of the pin, along a portion of a length of the pin, the length defined in a direction of a central axis of the pin, where the roller is configured to rotate about the central axis and a hydrodynamic oil film wedge is formed between the outer surface of the pin and an inner surface of the roller;

a cylinder valve operative to be driven by the cam follower; and a pushrod coupled between the tappet of the cam follower and the cylinder valve, wherein the roller is configured to rotate around the outer surface of the pin including the depressed contour and wherein the depressed contour includes a crown tangent to the outer surface of the pin, the crown decreasing from the outer surface of the pin to a first curved end and a second curved end of the depressed contour, the first curved end and the second curved end recessed by an amount from the outer surface of the pin and positioned away from ends of the pin.

21. The system of claim 20, wherein the roller and pin are comprised of one or more steel materials and wherein the pin includes an oil passage inside the pin, where the oil passage opens on each side of the pin to deliver oil to the outer surface of the pin between the pin and the roller.

22. An engine comprising the cam follower of claim 1.

* * * * *